US009730476B1

(12) United States Patent
Mahar

(10) Patent No.: US 9,730,476 B1
(45) Date of Patent: Aug. 15, 2017

(54) LEGGING WITH MATERNITY SUPPORT

(71) Applicant: Leading Lady, Inc., Beachwood, OH (US)

(72) Inventor: William J. Mahar, Eastlake, OH (US)

(73) Assignee: LEADING LADY, INC., Beachwood, OH (US)

( * ) Notice: Subject to any disclaimer, the term of this patent is extended or adjusted under 35 U.S.C. 154(b) by 0 days.

(21) Appl. No.: 15/178,862

(22) Filed: Jun. 10, 2016

(51) Int. Cl.
*A41D 1/20* (2006.01)
*A41C 1/10* (2006.01)
*A41B 11/14* (2006.01)

(52) U.S. Cl.
CPC ..... *A41D 1/20* (2013.01); *A41B 11/14* (2013.01); *A41C 1/10* (2013.01)

(58) Field of Classification Search
CPC ..... A41D 1/20; A41D 13/0017; A41B 9/04; A41C 1/10; A41C 1/00; A41C 1/003; A41C 1/08; A41C 1/20; A41C 1/12
USPC ..... 450/155, 95, 8; 2/409, 220, 221, 227, 2/237, 236, 109
See application file for complete search history.

(56) References Cited

U.S. PATENT DOCUMENTS 5,255,393 A * 10/1993 Brady ..... A41D 1/20 2/409
5,787,512 A * 8/1998 Knox ..... A41B 11/14 2/409
5,915,531 A * 6/1999 Hilpert ..... A41D 13/0017 2/109
8,968,051 B1 * 3/2015 Carney ..... A41D 1/20 2/220
9,314,053 B2 * 4/2016 Melarti ..... A41C 1/12
2009/0270012 A1 * 10/2009 Melarti ..... A41C 1/10 450/8
2011/0230121 A1 * 9/2011 Fong ..... A41B 9/04 450/155
2012/0122372 A1 * 5/2012 Fong ..... A41C 1/003 450/155
2012/0309265 A1 * 12/2012 Abrams ..... A41C 1/00 450/95
2013/0106158 A1 * 5/2013 Keegan ..... B60N 2/2845 297/256.16
2015/0173424 A1 * 6/2015 Carney ..... A41D 1/20 450/155

(Continued)

*Primary Examiner* — Gloria Hale
(74) *Attorney, Agent, or Firm* — Renner, Kenner, Greive, Bobak, Taylor & Weber Co., L.P.A.

(57) ABSTRACT

Maternity garments are presented herein. The maternity garments are intended for use by pregnant women throughout the entirety of their pregnancy. In one exemplary arrangement, the maternity garments include a built-in support belt and a belly bump portion. The maternity garment may further include leggings. In some arrangements, the maternity garment is formed of light compression weaves in areas such as the baby bump area and the leggings area of the garment, while the areas around the periphery of the baby bump, as well as the back area of the garment are formed of slightly stronger compression weave so as to provide needed support and lift in these areas. Finally, the area associated with the middle of the back of the pregnant woman may be formed of an even stronger compression weave so as to provide even greater support in this area to deal with the troublesome soreness and pain often had by pregnant woman as the pregnancy progresses.

8 Claims, 2 Drawing Sheets

(56) References Cited

U.S. PATENT DOCUMENTS

| | | | | |
|---|---|---|---|---|
| 2016/0015087 | A1* | 1/2016 | Hendrickson | A41D 1/20 450/95 |
| 2016/0015088 | A1* | 1/2016 | Hendrickson | A41C 1/08 450/95 |
| 2016/0050982 | A1* | 2/2016 | Kohrherr | A41C 1/10 450/95 |

* cited by examiner

LEGGING WITH MATERNITY SUPPORT

TECHNICAL FIELD

The disclosure herein resides generally in the art of maternity garments and, more particularly, to a maternity garment having leggings and maternity support.

BACKGROUND ART

Many maternity garments, especially undergarments, have been developed over the years to address various problems associated with providing appropriate clothing and support to women during pregnancy. U.S. Pat. No. 5,094,648 discloses a maternity support top with a built in bra and a two-inch bellyband that lifts weight off of the pelvis. This garment, however, focuses only on the upper torso of a pregnant woman and does not address the hip or buttock area, or the legs.

Spanx® brand maternity hosiery provides undergarment support in a full-length panty hose with a non-binding waistband with under belly support. However, the Spanx® maternity hosiery is not configured to providing support for the upper body.

U.S. Pat. No. 5,702,286 discloses a back and abdominal support worn over the brassiere and under the panties, and with a supportive band under the tummy. However, this garment only covers the upper torso of a pregnant woman and does not address the hip or buttock area, or the legs.

U.S. Pat. No. 7,181,755 discloses a knit fabric band that is worn over pants that are either too tight or too loose, holding them in place. The band is worn as a single layer over the tummy and is designed to stretch as the tummy grows. The band, however, does not address the torso, the back, or the legs. Nor does the band perform a support function.

U.S. Pat. No. 8,864,551 discloses a maternity garment made of high performance fabric which provides mild support to shape a woman's body. The garment, however, requires either the garment to be worn over the shoulders of the woman, or the degrees of compression of the fabric are not properly tailored to the needs of a pregnant woman.

Thus, traditional maternity support garments such as those described above only target a specific area of the body and only solve a limited few problems. Therefore, a need exists for an all-in-one garment that simultaneously addresses several areas, including smoothing a woman's profile, improving her level of comfort, providing her needed support, and complimenting her desired aesthetics. There is also a need in the art for a maternity support garment that may be worn throughout the entirety of a pregnancy while providing the necessary comfort and support that the expecting mother needs and deserves.

SUMMARY

The needs apparent from the deficiencies of the prior art as noted above are satisfied by various embodiments of the disclosure presented directly below and as will become apparent in detail with reference to the drawings and detailed description.

In a first exemplary embodiment, a maternity garment is disclosed wherein the maternity garment comprises: a leggings portion, a belly bump portion, and a built-in support belt.

In a second exemplary embodiment, the built-in support belt may further comprise an enhanced back support panel.

In a third exemplary embodiment, the leggings portion and the belly bump portion is formed from a light compression weave.

In a fourth exemplary embodiment, the built-in support belt is formed from a medium compression weave.

In a fifth exemplary embodiment, the enhanced back support panel is formed from a heavy compression weave.

In a sixth exemplary embodiment, the maternity garment is constructed as a seamless maternity garment.

In a seventh exemplary embodiment, the maternity garment further comprises a friction, tension and/or elastic band.

In an eighth exemplary embodiment, the friction, tension and/or elastic band is located above the built-in support belt.

In a ninth exemplary embodiment, the maternity garment is made from a material selected from the group consisting of Lycra®, Spandex®, Nylon®, micro denier, polyester, cotton or the like, including various blends thereof.

In a tenth exemplary embodiment, a maternity support garment comprises a lower belly support section, an upper belly support section, a baby bump section, and a back support panel.

In an eleventh exemplary embodiment, the back support panel further comprises an enhanced back support panel.

In a twelfth exemplary embodiment, the belly bump section is formed from a light compression weave.

In a thirteenth exemplary embodiment, the maternity support garment further includes two side support sections, and wherein the lower belly support section, the upper belly support section, and the back support panel are formed from a medium compression weave.

In a fourteenth exemplary embodiment, the enhanced back support panel is formed from a heavy compression weave.

In a fifteenth exemplary embodiment, the maternity support belt is a seamless maternity support belt.

In a sixteenth exemplary embodiment, the maternity garment further comprises a friction, tension and/or elastic band located above the upper belly section and the back support panel.

In a seventeenth exemplary embodiment, a maternity support garment is disclosed that further comprises a pair of leggings extending from said two side support sections, the lower belly support section, and the back support panel.

In an eighteenth exemplary embodiment, the leggings are in seamless interconnection with said two side support sections, the lower belly support section, and the back support panel.

In a nineteenth exemplary embodiment, the leggings are formed from a light compression weave.

DESCRIPTION OF DRAWINGS

For a complete understanding of the various aspects of the disclosure, reference should be made to the following detailed description and accompanying drawings, wherein.

DETAILED DESCRIPTION

Figure 1:
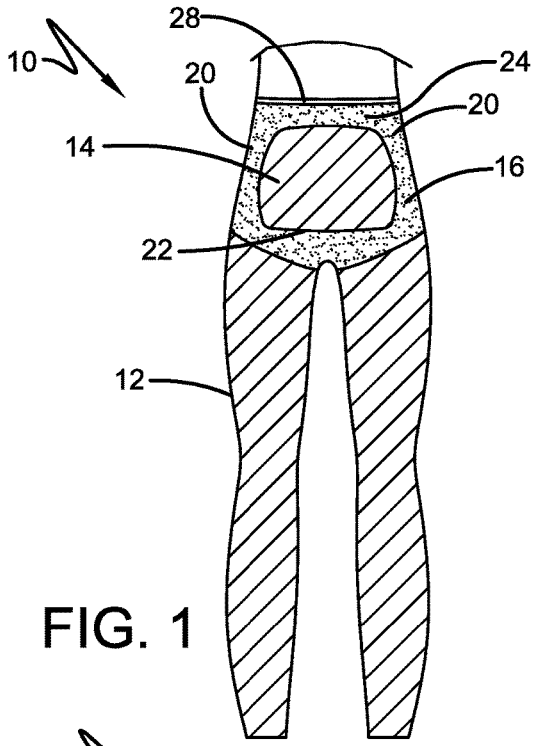
FIG. 1 is a front elevational view of a legging with maternity support according to a first exemplary arrangement.

Referring now to the drawings and more particularly to FIGS. 1 through 4, it can be seen that a maternity garment, made in accordance with an exemplary arrangement, is designated generally by the numeral 10. The garment 10 has a leggings portion 12, a belly bump portion 14, a built-in maternity support belt 16, and an enhanced back support panel 18. The maternity support belt 16 may be constructed with two side support sections 20, a lower belly support section 22, an upper belly support section 24, and a back support panel 26. The maternity support garment 10 also optionally contains an elastic or friction band 28. In one exemplary arrangement, the maternity garment 10 may cover a woman's belly, back, sides, hips, and legs, extending down from right above a pregnant woman's "belly bump" to the woman's ankles, right above her feet. However, other arrangements are also contemplated. For example, in one arrangement, the maternity garment 10 may be designed to extend just past the woman's knee, so as to be capri length. In another exemplary arrangement, the maternity garment may be designed to extend above the knee such as shorts.

Figure 3:
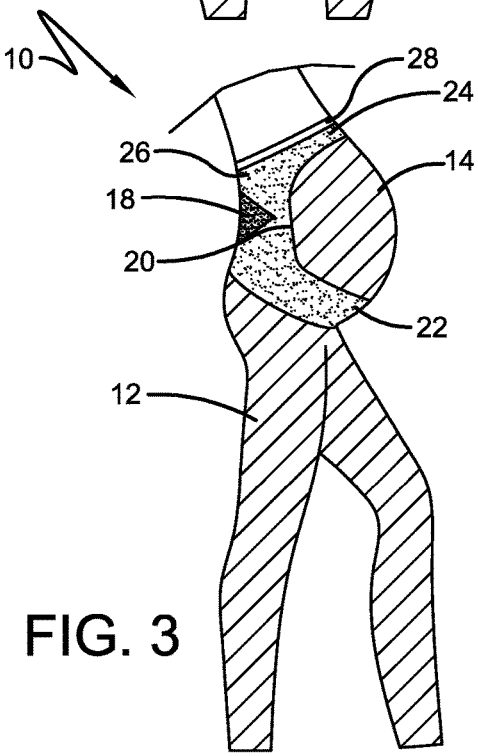
FIG. 3 is a right side view of the legging with maternity support of FIG. 1.
Figure 4:
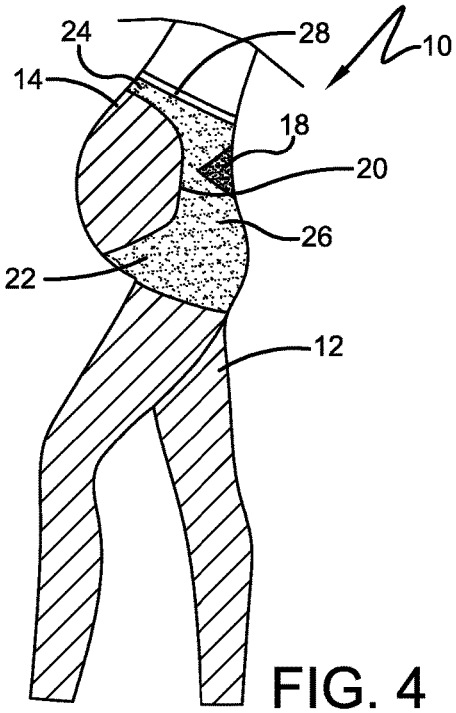
FIG. 4 is a left side view of the legging with maternity support of FIG. 1.

With reference to FIGS. 1, 3 and 4, in one exemplary arrangement, the belly bump portion 14 of the maternity garment 10 is configured to cover the portion of the woman's belly that will expand due to the growth of the baby. Belly bump portion 14 desirably adapts to the changing size of the woman's belly and is configured to expand with the growing belly for maximum comfort. In one exemplary arrangement, the belly bump portion 14 is made of a light compression weave, which will cover the baby bump and expand with limited resistance as the baby develops.

In an alternative arrangement, the belly bump portion 14 of the maternity garment 10 is configured as an opening. More specifically, rather than forming the belly bump portion 14 with a layer of material that will gradually stretch to accommodate the mother's growing belly, the growing belly will naturally extend out of the opening that is bounded by the two side support sections 20, lower belly support section 22, and upper belly support section 24.

With reference to FIGS. 1 through 4, in one exemplary arrangement, the leggings portion 12 of the maternity garment 10 covers the legs of the woman, extending down from around the hips of the woman, all the way to the woman's ankles. However, as set forth above, the present disclosure is not limited to leggings of this length. The leggings portion 12 of the maternity garment 10 is also made of a light compression weave, and in one exemplary arrangement, from the same light compression weave as the belly bump portion 14, for those arrangements that include a fabric belly bump portion 14. Due to the light compression provided by the light compression weave, the leggings portion 14 may serve to provide vascular support to the legs to minimize problems such as varicose veins, which are common during pregnancy.

With reference to FIGS. 1 through 4, the built-in maternity support belt 16 of the maternity garment 10 comprises two side support sections 20, a lower belly support section 22, an upper belly support section 24, and a back support panel 26. The maternity support belt 16 of the maternity garment 10 is made of a stronger compression weave than the light compression weave of the belly bump portion 14 and leggings portion 12. The strong compression weave of the maternity support belt 16 provides support to the ever-growing belly of a pregnant woman. Specifically, the two side support sections 20 and the lower belly support section 22 help lift and cradle the belly and desirably alleviate some discomforts caused by the weight and pressure of the growing belly. Furthermore, the upper belly section 24 also cradles the belly while the back support panel 26 provides back support to alleviate similar discomforts in the woman's back caused by the weight and pressure of the growing belly.

Figure 2:
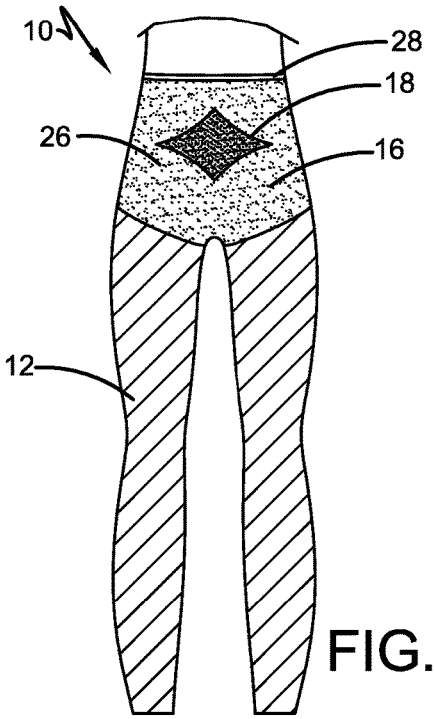
FIG. 2 is a back view of the legging with maternity support of FIG. 1.

With reference to FIG. 2, the enhanced back support panel 18 of the maternity garment 10 is located in the small of the back of the woman to provide for enhanced back support in this particular area of the woman's back where she feels the most discomfort caused by the weight and pressure of the growing belly. Although the exemplary arrangement shown in the figures is depicted in a diamond shaped pattern, the back support panel 18 is not limited to such a shape and can be any shape necessary to provide the proper support to the small of the woman's back. The enhanced back support panel 18 of the maternity garment 10 is made of the strongest compression weave relative to the other components of the maternity garment 10, even stronger than the compression weave used for the maternity support belt 16 of the maternity garment 10. Having the enhanced back support panel 18 being made of the strongest compression weave used in the maternity garment 10 allows for the enhanced back support panel 18 to provide the strongest compression needed at the troublesome area of a woman's small of the back during pregnancy.

In one exemplary arrangement, the entire maternity garment 10 is constructed as a seamless garment. By seamless, it is understood that, in certain embodiments, the maternity garment is made of one single material having a continuous weave. This means, that the transition from the light compression leggings 12 to the medium compression maternity support belt 16, from the medium compression maternity support belt 16 to the light compression baby bump section 14, and from the medium compression maternity support belt 16 to the strongest compression enhanced back section 18 is seamless. The change in the compression from section to section of the maternity garment 10 may be changed by changing only the density and weight, or grams per square meter, of the weave itself, as the garment 10 is formed with no seams being needed. Alternatively, and as contemplated by the disclosure, the material, or blend of materials, may change in the continuous wave process to achieve the desired compression characteristics from section to section. Because the maternity garment 10 is seamless, it avoids unnecessary bulk and ensures a comfortable and smooth silhouette while at the same time providing no irritation to the pregnant woman, irritation which a garment having seams would deliver.

Any fabrics having the appropriate compression and/or elasticity as described above could be used to create the maternity garment 10, such as, and without limitation, Lycra®, Spandex®, Nylon®, micro denier, polyester, cotton or the like, including various blends thereof.

According to one exemplary embodiment of the disclosure, the material used to form the garment 10 is of the same composition throughout, with only the density of the weave changing, although it is contemplated that the material itself may be of varying blends in the various sections and panels. One embodiment contemplates the light compression weave to be of a fabric weight of 120-320 grams per square meter ("gsm"), the medium compression weave to be a fabric weight of 200-400 gsm, and the heavy compression weave to be of a fabric weight of over 300 gsm. Of course, for the various garments made according to the invention, the general ratios of light-to-medium-to-heavy will remain rather consistent as between the lower and upper ends of the spectrum. In particular, the light compression weave will have a fabric weight lighter than the medium compression weave, and the medium compression weave will have a fabric weight lighter than the heavy compression weave. Those skilled in the art will appreciate that the elasticity of any particular section or panel of the garment 10 will be a function of the material composition, thread weave, and density or weight of the material.

The optional elastic or friction band 28 may be attached to the top of the upper belly section 24 and back support panel 26 of the maternity support belt 16. Friction band 28 preferably serves to ensure that the entire maternity garment 10 stays put where desired. In some exemplary arrangements, the friction band 28 is generally made of a slip-resistant material and preferably having elastic qualities, such as for example silicone. To one having ordinary skill in the art it is understood that various materials with elasticity may be used so as to ensure proper resistance without restriction on the body. In an alternative embodiment, friction band 28 may be created using tighter knit or higher compression fabric than even the strongest compression weave of the enhanced back support panel 18. It some embodiments it is desirable that the friction band 28 be attached to garment 10 in a seamless fashion so as to avoid any additional bulk and to ensure a comfortable, smooth silhouette; however, it is considered that an appropriately strong yet concealed and/or concealable seam may alternately be utilized.

Referring now to FIGS. 5 through 8, an alternative exemplary arrangement of a maternity garment is designated generally by the numeral 100. The garment 100 is generally in the form of a maternity support belt and is generally the nature of the garment 10, but without the leggings 12. In that regard, its characteristics, method of manufacture, and the materials employed are quite akin to those characteristics listed above in regards to garment 10. The maternity support belt 100 comprises two side support sections 120, a lower belly support section 122, an upper belly support section 124, a belly bump portion 125, a back support panel 126, and an enhanced back support panel 130. The maternity support belt 100 also optionally contains an elastic or friction band 128. The maternity support belt 100 preferably provides support for a woman's belly, back, sides, and hips, extending down from right above a pregnant woman's "belly bump" to right below her belly.

The two side support sections 120, the lower belly support section 122, the upper belly support section 124, and the back support panel 126 of the maternity support belt 100 is made of a strong compression weave. The strong compression weave of the two side support sections 120, the lower belly support section 122, the upper belly support section 124, and the back support panel 126 provides support to the ever-growing belly of a pregnant woman. Specifically, the two side support sections 120 and the lower belly support section 122 help lift and cradle the belly and desirably alleviate some discomforts caused by the weight and pressure of the growing belly. Furthermore, the upper belly section 124 also cradles the belly while the back support panel 126 provides back support to alleviate similar discomforts in the woman's back caused by the weight and pressure of the growing belly.

Figure 5:
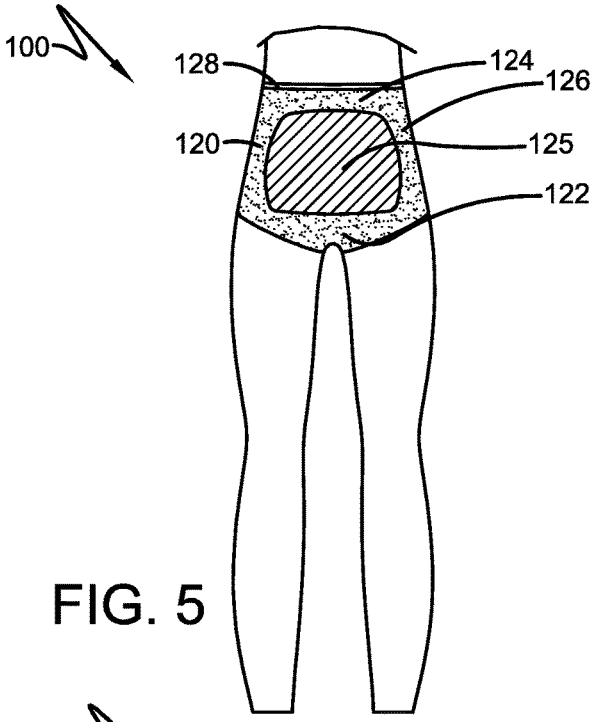
FIG. 5 is a front view of a support belt according to an exemplary arrangement.
Figure 7:
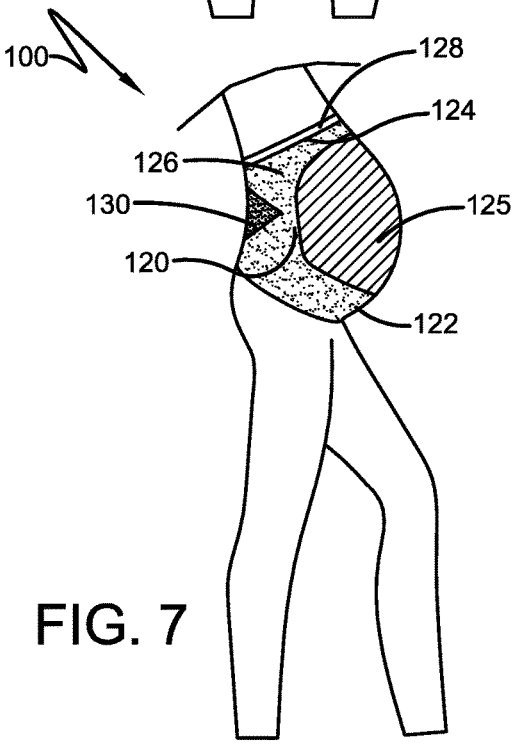
FIG. 7 is a right side view of the support belt of FIG. 5.
Figure 8:
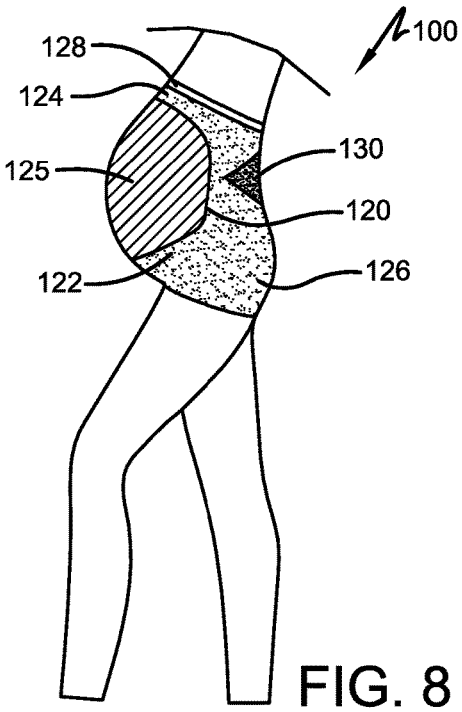
FIG. 8 is a left side view of the support belt of FIG. 5.

With reference to FIGS. 5, 7 and 8, the belly bump portion 125 of the maternity support belt 100 may be configured to cover the belly of the woman that will expand due to the growth of the baby. In one exemplary arrangement, the material for the belly bump portion 125 adapts to the changing size of the woman's belly and is configured to expand for maximum comfort. In this arrangement, the belly bump portion 125 is made of a light compression weave, which will cover the baby bump and expand as the baby develops. Alternatively, as described above in connection with the arrangement for maternity garment 10, the belly bump portion 125 may be configured as an opening through which the expending belly may protrude. As the opening is bounded by the side support section 120, the lower belly support section 122, and the upper belly support section 124, the expanding belly is supported by the garment 100.

Figure 6:
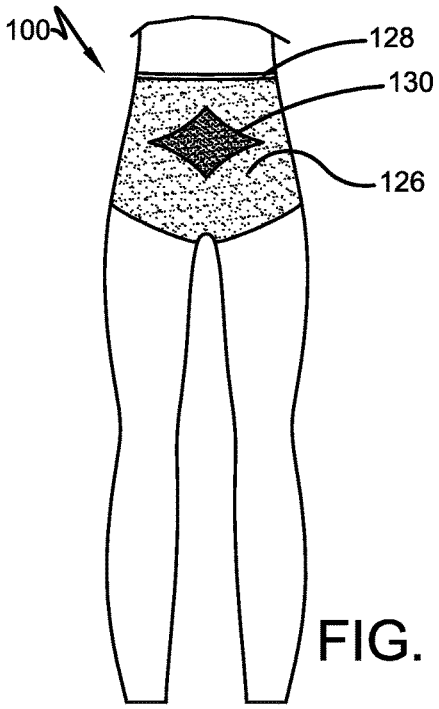
FIG. 6 is a back view of the support belt of FIG. 5.

With reference to FIG. 6, the enhanced back support panel 130 of the maternity support belt 100 is located in the small of the back of the woman to provide for enhanced back support in this particular area of the woman's back where she is most likely to feel the most discomfort caused by the weight and pressure of the growing belly. Although shown in the figures as being in a diamond shaped pattern, the back support panel 130 is not limited to such a shape and can be any shape necessary to provide the proper support to the small of the woman's back. The enhanced back support panel 130 of the maternity support belt 100 is made of a stronger compression weave than the strong compression weave of the two side support sections 120, the lower belly support section 122, the upper belly support section 124, and the back support panel 126. Having the enhanced back support panel 130 being made of the strongest compression weave used in the maternity support belt 100 allows for the enhanced back support panel 130 to provide the strongest compression needed at the troublesome area of a woman's small of the back during pregnancy.

One exemplary feature of the maternity support belt 100 is that the entire garment is a seamless garment. By seamless, it is understood that the maternity garment is made of one single material having a continuous weave. This means that the transition from the strong compression weave of the back support panel 126 to the strongest compression weave of the enhanced back section 130 is seamless. The change in the compression from section to section of the maternity support belt 100 is effected by changing only the density and strength of the weave itself, no seams are needed. By having the maternity support belt 100 be seamless, it allows for the maternity support belt 100 to avoid any additional bulk and it ensure a comfortable and smooth silhouette while at the same time providing no irritation to the pregnant woman, irritation which a garment having seams would deliver.

Any fabrics having the appropriate compression and/or elasticity as described above could be used to create the maternity support belt 100, such as, and without limitation, Lycra®, Spandex®, Nylon®, micro denier, polyester, cotton/polyester blend or the like, including various blends thereof.

The optional elastic or friction band 128 may be attached to the top of the upper belly section 124 and back support panel 126 of the maternity support belt 100. Friction band 128 preferably serves to ensure that the entire maternity support belt 100 stays put where desired. In some embodiments, the friction band 128 is generally made of a slip-resistant material, preferably having elastic qualities, such as for example silicone. To one having ordinary skill in the art it is understood that various materials with elasticity may be used so as to ensure proper resistance without restriction on the body. In an alternative embodiment, friction band 128 may be created using tighter knit or higher compression fabric than even the strongest compression weave of the enhanced back support panel 130. It some embodiments it is desirable that the friction band 128 be attached to the maternity support belt 100 in a seamless fashion so as to avoid any additional bulk and to ensure a comfortable, smooth silhouette; however, it is considered that an appropriately strong yet concealed and/or concealable seam may alternately be utilized.

It will be appreciated that the maternity garments and components thereof described herein have broad applications. The foregoing embodiments were chosen and described in order to illustrate principles of the garments as well as some practical applications. The preceding description enables others skilled in the art to utilize the various embodiments and with various modifications as are suited to the particular use contemplated. In accordance with the provisions of the patent statutes, the principles and modes of operation of this disclosure have been explained and illustrated in exemplary embodiments.

It is intended that the scope of the present methods and apparatuses be defined by the following claims. However, it must be understood that this disclosure may be practiced otherwise than is specifically explained and illustrated without departing from its spirit or scope. It should be understood by those skilled in the art that various alternatives to the embodiments described herein may be employed in practicing the claims without departing from the spirit and scope as defined in the following claims. The scope of the disclosure should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. Furthermore, all terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary. It is intended that the following claims define the scope of the invention and that the method and apparatus within the scope of these claims and their equivalents be covered thereby. In sum, it should be understood that the invention is capable of modification and variation and is limited only by the following claims.

What is claimed is:

1. A maternity garment, comprising:

a leggings portion;

a belly bump portion configured to cover a belly bump of a wearer when worn; and a built-in support belt;

wherein said leggings portion and said belly bump portion are formed from a first compression weave, a first section of said built-in support belt is formed from a second compression weave that exhibits a compression greater than the first compression weave, said built-in support belt further comprises an enhanced back support portion formed from a third compression weave that exhibits a compression greater than the second compression weave; and wherein the maternity garment is a single-layered seamless maternity garment formed from a single material having a continuous weave throughout each of said portions and said support belt.

2. The maternity garment as recited in claim 1 further comprising a friction band located above said built-in support belt.

3. The maternity garment of claim 1, wherein the maternity garment is made from a material selected from the group consisting of elastic synthetic polymer material, micro denier, polyester, and cotton/polyester blend, including various blends thereof.

4. A maternity support garment comprising:

two side support sections;

a lower belly support section;

an upper belly support section;

a baby bump section interposed between said two side support sections and said lower and upper belly support sections and configured to cover a belly bump portion of a wearer when the maternity support garment is worn; and a back support panel interconnecting said side support sections; and wherein said belly bump section is formed from a first compression weave, said two side support sections, said lower belly support section, said upper belly support section, and a portion of said back support panel are formed from a second compression weave that has a greater compression than said first compression weave, and wherein said back support panel further comprises an enhanced back support panel that is formed from a third compression weave that has a greater compression than said second compression weave; and wherein the maternity support garment is a single layer seamless maternity support garment formed from a continuous weave of a single material.

5. The maternity support garment as recited in claim 4, further comprising a friction band about a top portion of the maternity garment above both the upper belly section and the back support panel.

6. The maternity support garment of claim 4, wherein the maternity support belt is made from a material selected from the group consisting of elastane material, elastic synthetic polymer material, micro denier, polyester, and cotton, including any blends thereof.

7. The maternity support garment of claim 4, further comprising a pair of leggings extending from said two side support sections, the lower belly support section, and the back support panel.

8. The maternity support garment of claim 7, wherein said leggings are in seamless interconnection with said two side support sections, the lower belly support section, and the back support panel.

* * * * *